US007152340B2

(12) United States Patent
Issler

(10) Patent No.: US 7,152,340 B2
(45) Date of Patent: Dec. 26, 2006

(54) SYSTEM FOR REMOVABLY PLACING A PAD ON A SHOE

(75) Inventor: James E. Issler, Greenwich, CT (US)

(73) Assignee: Columbia Insurance Company, Omaha, NE (US)

( * ) Notice: Subject to any disclaimer, the term of this patent is extended or adjusted under 35 U.S.C. 154(b) by 274 days.

(21) Appl. No.: 10/864,258

(22) Filed: Jun. 9, 2004

(65) Prior Publication Data

US 2005/0274042 A1 Dec. 15, 2005

(51) Int. Cl.
*A43C 13/00* (2006.01)
*A43B 13/36* (2006.01)

(52) U.S. Cl. ..... 36/15; 36/100; 36/132

(58) Field of Classification Search ..... 36/15, 36/132, 135, 100, 101
See application file for complete search history.

(56) References Cited

U.S. PATENT DOCUMENTS

| | | | | |
|---|---|---|---|---|
| 2,640,283 A | | 6/1953 | McCord | 36/25 R |
| 2,776,499 A | * | 1/1957 | Giuntini | 36/135 |
| 3,027,661 A | | 4/1962 | McCord | 36/30 R |
| 3,672,077 A | | 6/1972 | Coles | 36/2.5 T |
| 4,279,083 A | * | 7/1981 | Dilg | 36/101 |
| 4,301,604 A | * | 11/1981 | Hamilton | 36/130 |
| 4,807,372 A | * | 2/1989 | McCall | 36/135 |
| 5,410,821 A | * | 5/1995 | Hilgendorf | 36/100 |
| 6,243,973 B1 | | 6/2001 | Lind | 36/130 |
| 6,311,415 B1 | | 11/2001 | Lind | 36/130 |
| 6,442,869 B1 | * | 9/2002 | Coomes | 36/11.5 |
| 6,598,324 B1 | | 7/2003 | Tsuji | 36/130 |
| 6,651,360 B1 | | 11/2003 | Lind | 36/130 |
| 6,662,476 B1 | | 12/2003 | Lind | 36/130 |
| 2004/0088883 A1 | * | 5/2004 | Workman | 36/15 |

FOREIGN PATENT DOCUMENTS

| | | | |
|---|---|---|---|
| GB | 2178940 | * | 2/1987 |

* cited by examiner

*Primary Examiner*—Marie Patterson
(74) *Attorney, Agent, or Firm*—St. Onge Steward Johnston & Reens LLC

(57) ABSTRACT

The invention relates to a system for removably placing a pad on a shoe, including a bottom surface of the shoe, a pad secured to the bottom surface, an extension extending from the pad, the extension being secured to the bottom surface, and wherein the extension facilitates removal or application of the pad to the bottom surface.

13 Claims, 2 Drawing Sheets

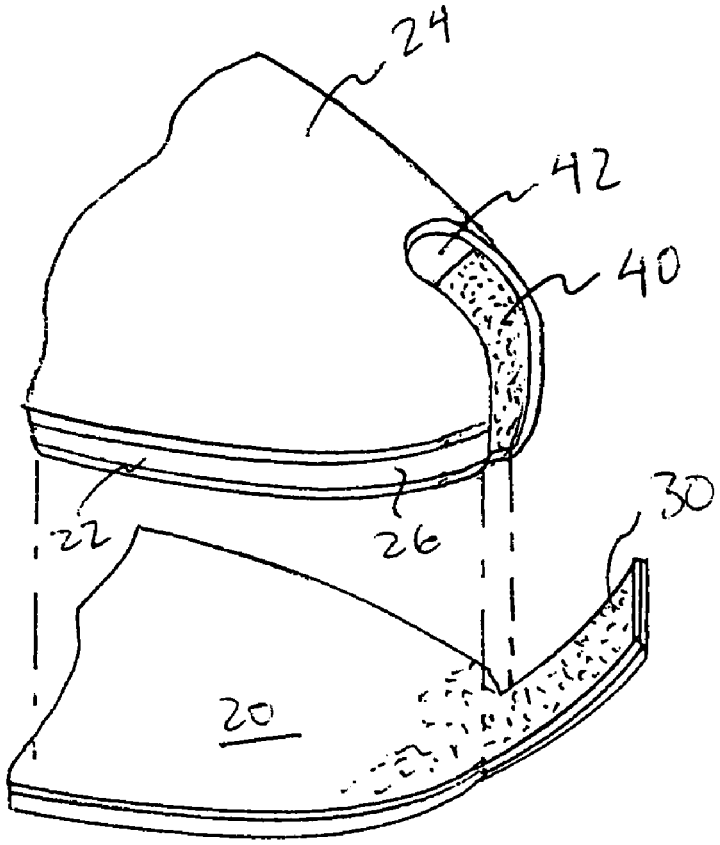
FIG. 3
FIG. 4
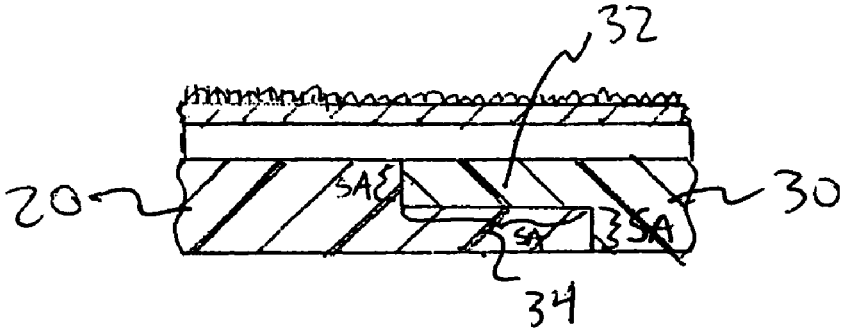
FIG. 5
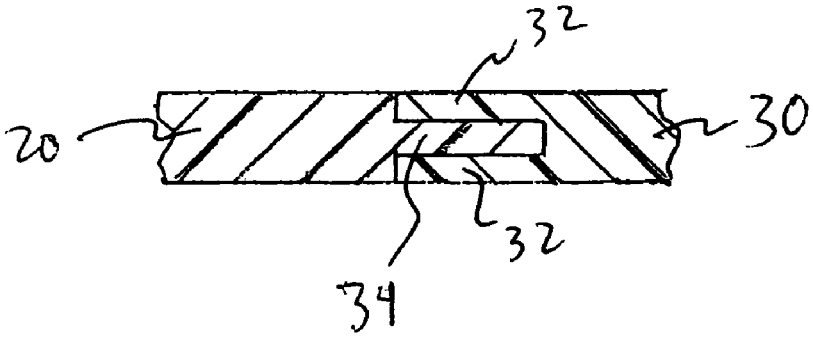

SYSTEM FOR REMOVABLY PLACING A PAD ON A SHOE

FIELD OF THE INVENTION

The invention relates to an improved bowling shoe.

BACKGROUND OF THE INVENTION

Bowlers may wear bowling shoes for a variety of reasons, such as improved sliding on a lead foot and improved traction on a rear, or push, foot. Therefore, the material of the bottom of the bowling shoes, which contacts the walking surface, may affect the ability to slide and/or grip the surface. More-over, as bowlers bowl at different bowling alleys, particularly bowlers who travel such as professional bowlers, varying finishes on the surfaces at varying bowling alleys may also affect the ability to slide and/or grip the surface. Hence, a bowler who uses the same bowling shoes may experience different sliding and/or gripping depending upon the bowling alley. To overcome these variations, a bowler may travel with numerous bowling shoes and select a particular pair of shoes depending upon the finish the bowler encounters. However, in doing so, the bowler would often have to incur increased expenses to acquire numerous bowling shoes as well as be inconvenienced with traveling and maintaining numerous shoes.

Therefore, a bowling shoe having an outsole that may be replaced with any one of a plurality of outsoles, each outsole having different frictional properties than the next outsole, may permit a user to adjust a single pair of shoes to numerous surfaces having various frictional characteristics. U.S. Pat. No. 2,640,283 to McCord, U.S. Pat. No. 3,027,661 to McCord, and U.S. Pat. No. 5,542,198 to Famolare appear to relate to a bowling shoe that permits a pad on the bottom of the outsole to be interchanged with any one a plurality of pads, each pad having different frictional properties.

However, such shoes with replaceable pads may introduce a new type of problem where the pad may become unintentionally loosened or dislodged from the outsole. As a result, the pad could flop around and pose a hazard to the user, sometimes causing the user to trip or fall. This problem may be exacerbated when the user drags the shoe, particularly the toes, such as a bowler often does with the rear foot during the final stride prior to releasing the bowling ball.

During the final stride, some bowlers drag the rear foot from the ball of the foot up onto the top of the toes. As a result, the shoe typically experiences a drag beginning on the bottom surface of the pad underneath the ball of the foot (see FIG. 1*a*), continuing to where the outsole meets the upper in front of the toes (see FIG. 1*b*), and ending where the upper covers the top of the toes (see FIG. 1*c*). In general, for removable pads that should be securely attached to the bottom of shoes until such time the pads are intended to be removed, particularly for bowlers who drag their rear foot, there may be a need for an apparatus that securely attaches a removable and interchangeable pad to a bottom of a shoe that further permits, when desired, the pad to be easily removed and interchanged.

What is desired, therefore, is a shoe having an interchangeable outsole which is securely attached to the bottom of the shoe until such time it is desired to be interchanged, whereupon such outsole may be easily removed and interchanged. What is also desired is an interchangeable outsole that may be easily and repeatedly attached in its proper location to the bottom of the shoe.

SUMMARY OF THE INVENTION

It is therefore an object of the invention to provide a shoe having a removable outsole that is securely attached to the bottom of the shoe.

Another object of the invention is to provide a shoe that has a removably outsole that is easily removed and interchanged with another removable outsole.

A further object of the invention is to provide a shoe having a removable outsole that is easily removed and secured in the same location on a repeated basis.

There and other objects of the invention are achieved by a system for removably placing a pad on a shoe, including a bottom surface of the shoe, a pad secured to the bottom surface, an extension extending from the pad, the extension being secured to the bottom surface, and wherein the extension facilitates removal or application of the pad to the bottom surface.

The system may also include an extension that is removably secured to the bottom surface. In another aspect of the invention, the extension is integrally formed with the pad. The shoe may further have a side wall and wherein the extension is secured to the side wall of the shoe. The side wall may be part of the outsole or the upper.

Optionally, the system has a notch in a fore area of the bottom surface and where the extension is removably secured within the notch.

In addition to facilitating removal or application of the pad onto the bottom surface of the shoe, the extension may also serve as a guiding mechanism for facilitating placement of the pad on the outsole.

BRIEF DESCRIPTION OF THE DRAWINGS

FIG. 3 depicts a close up view of the pad and extension shown in FIG. 1.

FIG. 4 depicts the extension of FIG. 1 being removably secured to the pad.

FIG. 5 depicts another aspect of the extension of FIG. 1 being removably secured to the pad.

DETAILED DESCRIPTION OF THE DRAWINGS

Figure 1:
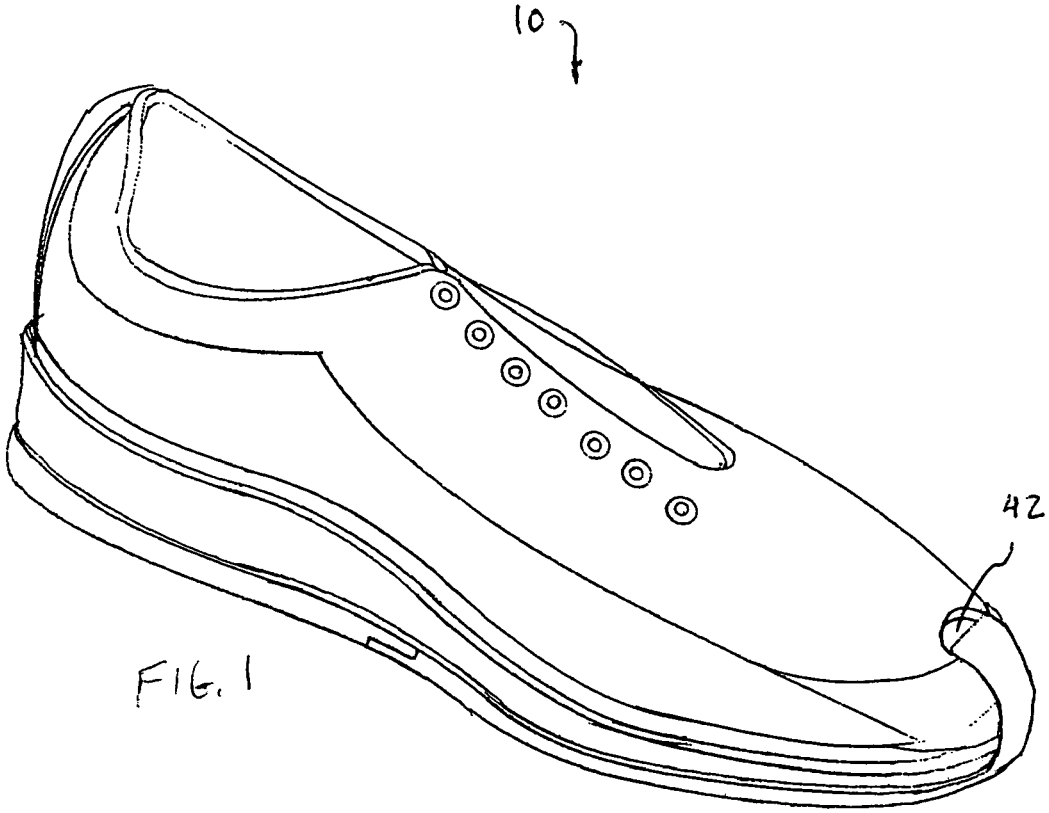
FIG. 1 depicts the system for removably placing a pad on a shoe in accordance with the invention
Figure 2:
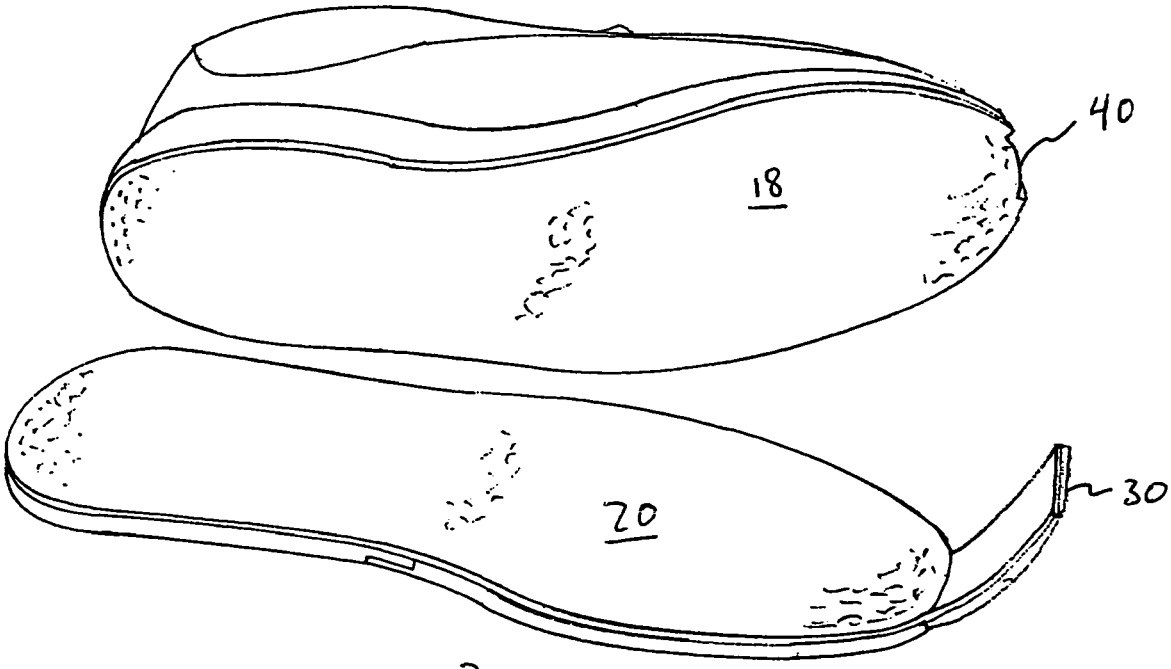
FIG. 2 depicts the pad of FIG. 1 separated from the rest of the shoe.

FIG. 1 depicts the system 10 in accordance with the invention where pad 20 is removably placed on bottom surface 18 of a shoe and further includes extension 30 for facilitating application and/or removal of pad 20 onto bottom surface 18. FIG. 2 shows pad 20 removed from bottom surface 18. Although the invention is most applicable for sports where interchanging pads are common, such as bowling, the invention is also applicable for any application where a pad for directly contacting a ground is desired to be removed or interchanged with another pad. Golf, boating, dancing, or tennis are just some examples of activities where a user may wish to have a pad that is removable and/or interchangeable with another pad.

Although extension 30 is shown to extend from the front of pad 20, this is not a requirement for system 10 to function properly. In other aspects of the invention, extension 30 extends from the rear or side of pad 20. In further aspects, at least two extensions are utilized. As shown, a single extension is sufficient for facilitating application and/or removal of pad 20 to bottom surface 18.

For facilitating application of pad 20 onto bottom surface 18, extension 30 acts as a guiding mechanism for locating pad 20 onto bottom surface 18. In some embodiments, bottom surface 18 may include notch 40, within which extension 30 is placed. Notch 40 provides an indentation in bottom surface 18 in which extension 30 may be repeatedly placed and, as a result, pad 20 may also be repeatedly placed on bottom surface 18 in approximately the same location. Extension 30 is secured to bottom surface 18 and/or pad 20 through all known or novel manners, such as hook and loop fasteners, adhesive, screws, rivets, and the like.

For facilitating removal of pad 20 from bottom surface 18, extension 30, which is connected to and extends from pad 20, is easily grasped by a user and, upon being lifted from bottom surface 18, facilitates lifting and removal of pad 20. In the embodiments having notch 40, the user grasps extension 30 that is placed in notch 40.

Notch 40 is a recess optionally placed in bottom surface 18 for providing a location for removably securing extension 30 to bottom surface 18. Further, because notch 40 is free from contact with a ground surface, extension 30 also does not contact the ground when extension 30 is removably placed within notch 40. Therefore, as the user walks in the shoe and pad 20 contacts the ground, extension 30 is less likely to become accidentally dislodged and, hence, pad 20 is also less likely to become accidentally dislodged. This is particularly advantageous when the shoe is dragged in the front of the shoe, such as the rear foot during bowling. In other applications, such as construction work, notch 40 may placed in bottom surface 18 in other locations, such as a side or rear of bottom surface 18.

As shown in FIG. 3, notch 40 extends from bottom surface 18 through a front side wall 26 of outsole 22 and partially through upper 24, all of which provide clearance for extension 30 from the ground. In other embodiments, notch 40 extends from bottom surface 18 and partially through a front side wall 26 of outsole 22 without penetrating upper 24. In any of these aspects, notch 40 may optionally include clearance 42 above where extension 30 sits within notch 40 so that a user may easily grasp extension 30.

In some aspects, extension 30 is integrally formed with pad 20. Where a plurality of pads are removably attached to bottom surface 18, each pad includes extension 30. In other aspects, extension 30 is removably secured to pad 20, wherein the plurality of pads may utilize the same extension.

FIGS. 4 and 5 depict cross sectional views of various manners for removably attaching extension 30 to pad 20. FIG. 4 shows extension 30 having step 32 and pad 20 also having step 34. Steps 32, 34 mate with each other along the surface area (indicated as SA in FIGS. 4 and 5) of the steps by any known or novel manners for attachment, such as hook and pile closures, adhesive, fasteners, and the like. The size of steps 32, 34 may vary to provide more or less surface area depending upon the type of activity encountered by the shoe.

FIG. 5 furthers the concept of FIG. 4 by providing additional steps for each of extension 30 and pad 20 and, therefore, increasing the surface area in contact between extension 30 and pad 20. By increasing the surface area in contact between extension 30 and pad 20, extension 30 and pad 20 are more strongly secured to one another.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A system for removably placing a pad on a shoe, comprising:

a bottom surface of the shoe;

at least two pads, each removably securable to said bottom surface;

an extension removably securable to and removably extending from each pad;

said extension being removably securable to said bottom surface; and wherein said extension facilitates removal or application of each pad to said bottom surface.

2. The system according to claim 1, further comprising a side wall and wherein said extension is removably secured to said side wall of the shoe.

3. The system according to claim 1, further comprising a notch in a fore area of said bottom surface.

4. The system according to claim 3, wherein said extension is removably secured within said notch.

5. The system according to claim 3, wherein said notch extends from said fore area to an upper and said extension is removably secured within said notch.

6. A system for removably placing a pad on a shoe, comprising:

a bottom surface of the shoe;

a plurality of pads, each being removably securable to said bottom surface;

a notch in a fore area of said bottom surface;

an extension removably securable to and removably extending from each pad;

said extension being removably securable within said notch; and wherein said extension facilitates removal or application of each pad to said bottom surface.

7. The system according to claim 6, further comprising an upper and wherein said notch extends from said fore area to said upper.

8. The system according to claim 7, wherein said extension is removably secured to said upper and said fore area.

9. The system according to claim 6, wherein said extension further includes a step and each pad of said at least two pads includes a step.

10. The system according to claim 9, wherein said step of said extension and said step of each pad of said at least two pads mate with and attach to each other along a surface of each step.

11. The system according to claim 6, wherein said extension further includes at least two steps and each pad of said at least two pads includes at least two steps, wherein each step of said extension mates with and attaches to each step of each pad.

12. A system for removably placing a pad on a shoe, comprising:

an outsole;

a plurality of pads, each being removably securable to said outsole;

a notch in a fore area of said outsole;

an extension removably securable to and removably extending from each pad;

said extension being removably securable within said notch; and wherein said extension facilitates removal or application of each pad to said outsole.

13. The system according to claim 12, further comprising hook and loop fasteners between said extension and said notch for removably securing said extension within said notch.

* * * * *